US008221564B2

(12) United States Patent
Kim et al.

(10) Patent No.: US 8,221,564 B2
(45) Date of Patent: Jul. 17, 2012

(54) METHOD FOR MANUFACTURING HIGH STRENGTH STEEL STRIPS WITH SUPERIOR FORMABILITY AND EXCELLENT COATABILITY

(75) Inventors: Seong-Ju Kim, Kyungsangbook-do (KR); Il-Ryoung Sohn, Kyungsangbook-do (KR); Hyun-Gyu Hwang, Kyungsangbook-do (KR); Seung-Bok Lee, Kyungsangbook-do (KR)

(73) Assignee: POSCO, Pohang (KR)

( * ) Notice: Subject to any disclaimer, the term of this patent is extended or adjusted under 35 U.S.C. 154(b) by 225 days.

(21) Appl. No.: 12/096,968

(22) PCT Filed: Dec. 22, 2006

(86) PCT No.: PCT/KR2006/005655

§ 371 (c)(1),
(2), (4) Date: Aug. 14, 2008

(87) PCT Pub. No.: WO2007/075008

PCT Pub. Date: Jul. 5, 2007

(65) Prior Publication Data

US 2008/0295928 A1 Dec. 4, 2008

(30) Foreign Application Priority Data

Dec. 26, 2005 (KR) ..... 10-2005-0129515

(51) Int. Cl.
*C21D 8/00* (2006.01)
*C22C 38/00* (2006.01)

(52) U.S. Cl. ..... 148/651; 148/320

(58) Field of Classification Search ..... 148/320, 148/648, 651; 420/87, 88, 103, 120, 129
See application file for complete search history.

(56) References Cited

U.S. PATENT DOCUMENTS

| | | | |
|---|---|---|---|
| 6,695,932 | B2 | 2/2004 | Kami et al. |
| 6,911,268 | B2 | 6/2005 | Takada et al. |

FOREIGN PATENT DOCUMENTS

| | | | | |
|---|---|---|---|---|
| CN | 1483090 | A | | 3/2004 |
| JP | 2274840 | A | | 11/1990 |
| JP | 4041658 | A | | 2/1992 |
| JP | 2002053931 | A | | 2/2002 |
| JP | 2002155317 | A | | 5/2002 |
| JP | 2002294397 | A | | 10/2002 |
| JP | 2004332099 | A | * | 11/2004 |
| JP | 2005290477 | A | * | 10/2005 |

OTHER PUBLICATIONS

Hanazawa et al., English machine translation of JP 2005-290477A, Oct. 2005.*
Fujita et al., English machine translation of JP 2004-332099A, Nov. 2004.*

* cited by examiner

*Primary Examiner* — Roy King
*Assistant Examiner* — Caitlin Kiechle
(74) *Attorney, Agent, or Firm* — The Webb Law Firm

(57) ABSTRACT

A method for manufacturing a steel sheet used for structural members, elements, etc. of automobiles including a front side member, pillar, and the like, and more particularly, a method for manufacturing a steel sheet having a high strength and formability as well as hot-dip galvanizing properties is disclosed. In the method, after an aluminum killed steel slab, which comprises, by weight %: C: 0.05% to 0.25%; Si: 0.1% to 1.5%; S: 0.02% or less; N: 0.01% or less; Al: 0.02% to 2.0%; Mn: 1.0% to 2.5%; P: 0.001% to 0.1%; Sb: 0.005% to 0.10%; the balance of Fe and other unavoidable impurities, is subjected to a homogenization treatment at a temperature range of 1050° C. to 1300° C., the aluminum killed steel slab is subjected to a hot rolling under a finishing hot rolling temperature of 850° C. to 950° C. and a coiling temperature of 400° C. to 700° C., followed by a cold rolling under a cold rolling reduction ration of 30% to 80%, and annealing the cold rolled steel sheet.

2 Claims, No Drawings

METHOD FOR MANUFACTURING HIGH STRENGTH STEEL STRIPS WITH SUPERIOR FORMABILITY AND EXCELLENT COATABILITY

TECHNICAL FIELD

The present invention relates to a method for manufacturing a steel sheet that is used for structural members, elements, etc. of automobiles, such as a variety of members of automobiles including a front side member, pillar, and the like, and more particularly, to a method for manufacturing a steel sheet having high strength and formability as well as hot-dip galvanizing properties.

BACKGROUND ART

Currently developed high strength steel for use in structural members of automobiles, etc. has a little formability and thus, is difficult to be used in the manufacture of elements having a complex shape.

Accordingly, manufacturers of automobiles have attempted to simplify the shape of elements, or to divide a relatively complex element into several sub-elements, for easy forming of the element.

However, the use of the several divided elements have a need for a secondary welding process. Moreover, since the strength of a welded joint differs from the strength of a base material, there is a serious limit in the design of an automobile body.

For this reason, manufacturers of automobiles have sought continuously for a high-strength steel material with superior formability, so as to use the steel material in the manufacture of elements having a complex shape and to increase a freedom in the designing of an automobile body. Meanwhile, even if the steel material has superior formability and high strength suitable for use in the manufacture of structural members of automobiles, etc., the steel material has a difficulty in a hot-dip galvanizing process if a great amount of an alloying element, more particularly, silicon (Si), is added into the steel material.

Furthermore, in the case where the steel material containing a great amount of silicon is manufactured in a continuous annealing or continuous hot-dip galvanizing line, there is the problem that metal grains in a surface of a steel sheet are dropped out and attached to and stacked on a hearth roll within a continuous annealing facility, thereby causing a dent defect in the subsequent coil.

Therefore, the present invention has been made in view of the above problems, and it is an aspect of the present invention to provide a method for manufacturing a steel sheet having high strength and formability as well as superior hot dip galvanizing properties by appropriately controlling the composition of steel and manufacturing conditions.

SUMMARY OF THE INVENTION

In accordance with the present invention, the above and other objects can be accomplished by the provision of a method for manufacturing a steel sheet having a high strength and formability as well as superior hot dip galvanizing properties, comprising: performing a homogenization treatment on an aluminum killed steel slab at a temperature range of 1050° C. to 1300° C., the aluminum killed steel slab comprising, by weight %: C: 0.05% to 0.25%; Si: 0.1% to 1.5%; S; 0.02% or less; N; 0.01% or less; Al; 0.02% to 2.0%; Mn; 1.0% to 2.5%; P; 0.001% to 0.1%; Sb; 0.005% to 0.10%; the balance of Fe and other unavoidable impurities; hot rolling the aluminum killed steel slab under a finishing hot rolling temperature of 850° C. to 950° C. and a coiling temperature of 400° C. to 700° C., to form a hot rolled steel sheet; cold rolling the hot rolled steel sheet under a cold rolling reduction ratio of 30% to 80%; and annealing the cold rolled steel sheet.

Preferably, one or more elements selected from the group consisting of Nb: 0.001% to 0.10%, Mo; 0.05% to 0.5%, and Co; 0.01% to 1.0% are added into the aluminum killed steel slab.

With the present invention, it is possible to provide a steel sheet having high strength and formability as well as superior hot dip galvanizing properties.

BEST MODE FOR CARRYING OUT THE INVENTION

Hereinafter, the present invention will be described in detail.

In the present invention, it is proposed to optimize the content of silicon. Silicon is an indispensable element to be added into a low carbon aluminum killed steel slab, in order to improve the strength and ductility of the steel. However, when a great amount of silicon is added, it may be enriched in the surface of the steel slab, thus causing a degradation in hot dip galvanizing properties of the steel slab. Also, in the present invention, it is proposed to add a small amount of antimony. Antimony serves to modify a surface oxide that is formed by addition of silicon, thereby achieving an improvement in the wettability of molten zinc during a hot dip galvanizing process and consequently, superior hot dip galvanizing properties of the steel slab.

In the present invention, further, to compensate for the strength of the steel slab when the content of silicon is reduced, the content of carbon and manganese, or additionally the content of one or more elements selected from among niobium, molybdenum and cobalt are added into the steel slab in an appropriately regulated content, so as to provide the steel with a high strength over a tensile strength of 590 MPa.

Furthermore, in the present invention, after implementation of a continuous hot dip galvanizing heat treatment, finally, a residual austenitic phase is distributed on ferrite having an extremely low carbon concentration, so as to achieve an improvement in the elongation and strain hardening exponent (n) of the resulting steel sheet despite the high tensile strength of the steel sheet.

That is to say, with the present invention, it is possible to manufacture a steel sheet having high strength and formability as well as superior hot dip galvanizing properties by the following manners: reducing the content of silicon; adding a small amount of antimony; appropriately adjusting the content of carbon and manganese, or additionally the content of one or more elements selected from among niobium, molybdenum and cobalt, in order to compensate for the strength of steel due to a reduction in the content of silicon; and distributing a residual austenitic phase on ferrite having an extremely low carbon concentration after implementation of a continuous hot dip galvanizing heat treatment. The manufactured steel sheet may be appropriately used as a base metal of a hot dip galvanized steel sheet.

Hereinafter, the reason to select elements for the steel sheet and to restrict the content range of the elements will be described in detail.

Carbon (C) is enriched in an austenitic phase during two-phase region annealing, slow-cooling, and rapid-cooling, and also, enriched in the austenitic phase during austempering in a bainite region, thereby contributing to reduce a transformation temperature of martensite in the austenitic phase below a room temperature.

Moreover, carbon has the effect of solid solution strengthening and the content of carbon has an effect on the fraction of a second phase.

That is to say, the greater the content of carbon, the amount of a residual austenite increases, and thus, the amount of martensite increases, resulting in an improvement in the strength and ductility of steel.

If the content of carbon is below 0.05% by weight (hereinafter, simply referred to as "%"), crystal grains are grown in steel and the effects of solid solution strengthening and precipitation strengthening by carbon are deteriorated. Therefore, it is impossible to achieve a sufficient tensile strength of steel.

Also, since an insufficient amount of residual austenite is formed in a conventional continuous annealing process, carbon contributes less to achieve an improvement in the strength and ductility of steel.

Accordingly, the content of carbon has to be more than 0.05%.

In the present invention, the content of silicon having the great solid solution strengthening effect is reduced. Therefore, it is necessary to add a great amount of carbon for a sufficient strength of steel. If the content of carbon exceeds 0.25%, it increases the solid solution strengthening effect as well as the tensile strength of steel due to an increased amount of the residual austenite. However, formation of a great amount of residual austenite exhibits the phenomenon of anti-delay rupture.

Moreover, if the content of carbon is too much, it causes a serious degradation in the weldability of steel.

Accordingly, the content of carbon is preferably limited to a range of 0.05% to 0.25%.

Manganese (Mn) has the effect of delaying ferrite transformation in the austenitic phase formed during two-phase region annealing, in addition to the effect of solid solution strengthening. Accordingly, the content of manganese has to be appropriately adjusted.

If the content of manganese is below 1.0%, manganese cannot sufficiently suppress transformation from austenite to pearlite. Therefore, pearlite is formed in the structure of the resulting steel sheet, and this results in a degradation in the strength and ductility of the steel sheet.

Moreover, since manganese has a great solid solution strengthening effect, the content of manganese has to be more than 1.0%, in order to achieve a sufficient tensile strength of steel.

However, if the content of manganese exceeds 2.5%, the strength of steel increases greatly due to an excessively high hardenability, thus causing a degradation in the formability and weldability of steel.

Accordingly, the content of manganese is preferably limited less than 2.5%.

Silicon (Si) has the effects of improving the strength of steel by virtue of its solid solution strengthening effect and of improving the ductility of steel by removing carbon from a ferrite phase.

In addition, silicon serves to suppress formation of carbide during bainite transformation, and thus, facilitates enrichment of carbon into the austenitic phase, thereby contributing greatly to formation of the residual austenitic phase. The residual austenitic phase is advantageous to improve the ductility of steel.

Accordingly, the content of silicon has to be more than 0.1%.

However, if the content of silicon increases excessively, there is the problem that a silicon oxide is formed on the surface of the steel sheet during a hot rolling process. The silicon oxide may deteriorate the efficiency of pickling.

In addition, silicon is enriched in the surface of the steel sheet during two-phase region annealing of a continuous hot dip galvanizing process. Accordingly, silicon acts to reduce the wettability of molten zinc relative to the surface of the steel sheet during the hot dip galvanizing process, resulting in a degradation in the efficiency of hot dip galvanization of the resulting steel sheet.

Moreover, if the content of silicon increases excessively, it causes a serious degradation in the weldability of steel.

Accordingly, the content of silicon has to be limited below 1.5%.

Phosphorus (P) is often added as a solid solution strengthening element, but, in the present invention, added to suppress formation of carbide during austempering while increasing the strength of steel.

That is to say, in the present invention, phosphorous has the same role as silicon.

Accordingly, if too little phosphorus is added, the content of carbon enriched in the residual austenitic phase is insufficient. This deteriorates the stability of the residual austenite, resulting in a reduction in the ductility of steel.

Accordingly, in the present invention, the content of phosphorous has to be more than 0.001%.

However, if the content of phosphorous exceeds 0.1%, there are problems of poor weldability of steel and a serious material property deviation of steel per a region by center segregation that is caused during continuous casting.

Accordingly, the content of phosphorous has to be limited less than 0.1%.

Aluminum (Al) is conventionally added for deoxidation of steel, but, in the present invention, added for improving the ductility of steel as well as deoxidation of steel.

In the present invention, aluminum has a role similar to silicon and phosphorous, and the content of aluminum is limited to a range of 0.02% to 2.0%.

If the content of silicon is too much, there is a problem of a seriously degradation in hot dip galvanizing properties and weldability of steel. Therefore, it is preferable that the content of silicon be reduced, and an appropriate amount of phosphorous and aluminum, serving as elements of suppressing formation of carbide, be added to achieve the same effect as silicon.

Moreover, aluminum is an element advantageous for improving hot dip galvanizing properties of the resulting steel sheet. Therefore, in the present invention, it is proposed to appropriately select the content of silicon, aluminum, and phosphorus.

Antimony (Sb) is an important element in the present invention, and has the great role of suppressing the surface enrichment of MnO, $SiO_2$, $Al_2O_3$, etc., and changing characteristics of the formed oxide, thereby achieving an improvement in the wettability of molten zinc relative to the steel sheet.

To obtain the above described effects, the content of antimony has to be at least 0.005%. However, when antimony is added beyond a predetermined amount, it is impossible to achieve desired effects. Accordingly, the upper limit value of the content of antimony is 0.10%.

Niobium (Nb) is an element added to improve the strength of steel, and serves to increase greatly the strength of steel without a degradation in hot dip galvanizing properties of the resulting steel sheet because it can result in fine crystal grains and precipitation strengthening effect.

If the content of niobium is below 0.001%, the content of a precipitate is little, thus contributing less to increase the strength of steel.

However, if the content of niobium exceeds 0.1%, there are problems that grains of the precipitate may be coarse depending on heat treatment conditions, a serious material property deviation may be caused by an excessive amount of fine precipitate, and the formability of steel may be deteriorated greatly.

Accordingly, the content of niobium is preferably limited to a range of 0.001% to 0.1%.

Molybdenum (Mo) also is an element added to improve the strength of steel, and serves to suppress formation of an oxide during a high temperature annealing process, thus achieving an improvement in the wettability of molten zinc relative to the steel sheet during a hot dip galvanizing process.

Although the content of molybdenum must be at least 0.05% to obtain the above described effect, it is preferable that the upper limit value of the content of molybdenum be limited to 0.5%. This is because the elongation rate of steel may be reduced greatly if the content of molybdenum exceeds the predetermined limit.

Cobalt (Co) is an element added to improve the strength of steel and serves to suppress formation of an oxide during high temperature annealing, thus achieving an improvement in the wettability of molten zinc relative to the steel sheet during a hot dip galvanizing process.

Although the content of cobalt must be at least 0.01% to obtain the above described effect, it is preferable that the upper limit value of the content of cobalt be limited to 1.0%. This is because the elongation rate of steel may be reduced greatly if the content of cobalt exceeds the predetermined limit.

Generally, sulfur (S) is an indispensable element for the manufacture of the steel sheet, and the content of sulfur is limited less than 0.02%.

Nitrogen (N) also is an indispensable element for the manufacture of the steel sheet, and the content of nitrogen is limited less than 0.010%.

Hereinafter, manufacturing conditions of the steel sheet according to the present invention will be described.

A steel slab prepared by the above described manner is reheated at a temperature of approximately 1050° C. to 1300° C., to perform a homogenization treatment. Then, the homogenized steel slab is subjected to a finishing hot rolling under conventional conditions within a temperature range of 850° C. to 950° C. right above the temperature of $Ar_3$, to form a hot rolled steel sheet. Thereafter, the hot rolled steel sheet is subjected to a coiling at a temperature range of 400° C. to 700° C.

If the coiling temperature is too low, a high strength second phase is formed in the hot rolled steel sheet, thereby causing an increase in the strength of the hot rolled steel sheet and making the shape of the hot rolled steel sheet poor after implementation of the hot rolling process. This is a factor of causing a difficulty in the cold rolling of the hot rolled steel sheet.

Accordingly, the coiling temperature is limited more than 400° C.

On the other hand, if the coiling hot rolling temperature is too high, coarse pearlite may be formed in the hot rolled steel sheet. The coarse pearlite has a difficulty in resolution during an annealing process and therefore, it is impossible to achieve the annealed steel sheet having homogeneous structure. This results in problems of not only reducing the formability of the resulting cold rolled steel sheet, but also increasing the annealing temperature.

Accordingly, the upper limit value of the coiling temperature is 700° C.

If the above hot rolling is completed, the steel sheet is subjected to a cold rolling, in order to adjust the shape and thickness of the steel sheet.

Preferably, a cold rolling reduction ratio is within a range of 30% to 80%.

Subsequently, the cold rolled steel sheet is subjected to continuous annealing in a two-phase region thereof.

In this case, if the annealing temperature is too low, it is difficult to achieve sufficient formability and transformation into austenite for maintaining an austenitic phase at a low temperature. Therefore, the annealing temperature is limited more than 700° C.

Moreover, the high annealing temperature of more than 700° C. is necessary to achieve complete re-solution of pearlite formed during the hot rolling, and consequently, uniform distribution of the second phase during cooling.

However, if the annealing temperature exceeds 870° C., the transformed austenite may be again transformed into ferrite during cooling. Therefore, the resulting steel sheet suffers from an insufficient carbon concentration of the residual austenite and a reduced elongation rate due to development of an acicular structure therein.

Accordingly, the upper limit value of the annealing temperature is 870° C.

After completing the high temperature annealing, preferably, the steel sheet is slowly cooled down to a temperature range of 620° C. to 700° C.

In this case, the cooling rate has to be maintained within a range of 1 to 7° C./sec, in order to achieve a sufficient amount of ferrite thereby increasing the formability of the steel sheet.

Preferably, the cooled steel sheet is subjected to a hot dip galvanizing process after being kept at a temperature range of 450° C. to 350° C. for more than 10 seconds.

Now, the present invention will be described in more detail with reference to an example.

EXAMPLE

Each steel slab having the composition shown in the following Table 1 was kept in a heating furnace of 1250° C. for 1 hour, followed by a hot rolling process.

In this case, a finishing hot rolling temperature was 900° C., and a coiling temperature was 620° C.

Then, the hot rolled steel sheet was subjected to a pickling process, followed by cold rolling at a cold rolling reduction ratio of 50%.

The cold rolled steel sheet was subjected to a continuous hot dip galvanizing heat treatment in which the annealing temperature was 800° C. and the temperature of a hot dip galvanizing bath was 460° C.

After completing the hot dip galvanizing heat treatment, a tensile test was performed by use of an universal tensile testing machine, and the results were represented in the following Table 2.

TABLE 1

| Steel | Chemical Composition (wt %) | | | | | | | | | |
|---|---|---|---|---|---|---|---|---|---|---|
| No. | C | Si | Mn | P | S | Al | Nb | Sb | Others | Remark |
| 1 | 0.206 | 0.49 | 2.02 | 0.011 | 0.0044 | 0.505 | 0.020 | 0.02 | — | Is |
| 2 | 0.189 | 0.50 | 2.10 | 0.010 | 0.0045 | 0.940 | 0.020 | 0.02 | — | Is |

TABLE 1-continued

| Steel | Chemical Composition (wt %) | | | | | | | | | |
|---|---|---|---|---|---|---|---|---|---|---|
| No. | C | Si | Mn | P | S | Al | Nb | Sb | Others | Remark |
| 3 | 0.195 | 0.54 | 1.99 | 0.009 | 0.0035 | 1.40 | 0.025 | 0.02 | — | Is |
| 4 | 0.204 | 0.48 | 1.93 | 0.030 | 0.0071 | 0.455 | 0.0120 | 0.018 | — | Is |
| 5 | 0.194 | 0.53 | 2.16 | 0.032 | 0.0064 | 1.100 | 0.0125 | 0.021 | — | Is |
| 6 | 0.250 | 0.51 | 1.50 | 0.049 | 0.0055 | 0.510 | — | 0.02 | — | Is |
| 7 | 0.203 | 0.53 | 1.52 | 0.052 | 0.006 | 0.518 | — | 0.02 | — | Is |
| 8 | 0.197 | 0.32 | 1.67 | 0.010 | 0.0055 | 0.510 | 0.012 | 0.021 | 0.16 Mo | Is |
| 9 | 0.200 | 0.31 | 1.65 | 0.010 | 0.0055 | 0.510 | 0.025 | 0.020 | 0.16 Mo | Is |
| 10 | 0.202 | 0.45 | 2.14 | 0.022 | 0.0070 | 1.05 | — | 0.030 | — | Is |
| 11 | 0.154 | 0.33 | 2.20 | 0.029 | 0.0060 | 0.539 | 0.010 | 0.020 | 0.54 Co | Is |
| 12 | 0.15 | 0.22 | 0.72 | 0.011 | 0.0050 | 0.72 | 0.025 | — | 0.53 Mo | Cs |
| 13 | 0.20 | 0.50 | 2.00 | 0.10 | 0.0050 | 0.70 | 0.025 | — | — | Cs |
| 14 | 0.20 | 1.6 | 1.6 | 0.01 | 0.005 | 0.05 | — | — | — | Cs |

Is: Inventive Steel, Cs: Comparative Steel

TABLE 2

| | Mechanical Properties | | | | |
|---|---|---|---|---|---|
| Steel No. | Yield Strength (MPa) | Tensile Strength (MPa) | Elongation rate (%) | Strain hardening exponent (n) | Surface Quality Grade |
| 1 | 488 | 840 | 28.5 | 0.21 | 1st |
| 2 | 560 | 790 | 28.3 | 0.22 | 1st |
| 3 | 520 | 787 | 29.3 | 0.23 | 1st |
| 4 | 580 | 830 | 27.7 | 0.21 | 1st |
| 5 | 600 | 830 | 28.0 | 0.21 | 1st |
| 6 | 382 | 810 | 28.0 | 0.22 | 1st |
| 7 | 453 | 708 | 31.0 | 0.22 | 1st |
| 8 | 622 | 798 | 28.2 | 0.22 | 1st |
| 9 | 590 | 790 | 29.0 | 0.21 | 1st |
| 10 | 431 | 754 | 27.6 | 0.23 | 1st |
| 11 | 550 | 800 | 26.8 | 0.21 | 1st |
| 12 | 431 | 625 | 22.0 | — | 1st |
| 13 | 550 | 785 | 28.0 | 0.21 | 3rd |
| 14 | 387 | 798 | 28.1 | 0.22 | 5th |

As can be seen from Table 2, Inventive Steels of Nos. 1 to 11 have a tensile strength of more than 590 MPa and an elongation rate of more than 25%.

Judging from the above results, it can be appreciated that the present invention can provide a material suitable for use in structural members of automobiles, such as a variety of members and pillar.

Comparative Steel No. 12 was obtained by reducing the content of manganese and excessively increasing the content of molybdenum having high hardenability. Accordingly, Comparative Steel No. 12 has a low tensile strength and elongation rate, and consequently, is unsuitable for use in high strength structural members.

Comparative Steel No. 13 was obtained by adding a sufficient amount of aluminum, niobium, etc., and thus, has high strength and ductility. However, with the absence of antimony (Sb), Comparative steel No. 13 suffers from a poor hot dip galvanizing quality, and thus, is unsuitable for use in structural members of automobiles requiring superior anti-corrosion abilities.

Comparative Steel No. 14 has a strength and ductility suitable for use in high strength structural members of automobiles, but cannot be used as a base steel sheet of a hot dip galvanized material because of a great amount of silicon added thereinto.

In addition, Comparative steel No. 14 has a problem in that the surface of the steel sheet may be partially peeled off within an annealing furnace during a high temperature annealing process, and be attached to a hearth roll, thereby causing a dent defect in the subsequent coil.

Although the preferred embodiments of the present invention have been disclosed for illustrative purposes, those skilled in the art will appreciate that various modifications, additions and substitutions are possible, without departing from the scope and spirit of the invention as disclosed in the accompanying drawings.

As apparent from the above description, the present invention has the effect of providing a steel sheet with high strength and formability as well as superior hot dip galvanizing properties.

The invention claimed is:

1. A method for manufacturing a steel sheet having high strength and formability and being suitable for hot dip galvanizing, comprising:

performing a homogenization treatment on an aluminum killed steel slab at a temperature of 1050° C. to 1300° C., the aluminum killed steel slab comprising, by weight %: C: 0.05% to 0.25%; Si: 0.1% to 1.5%; S: 0.02% or less; N: 0.01% or less; Al: 0.455% to 2.0%; Mn: 1.0% to 2.5%; P: 0.001% to 0.1%; Sb: 0.005% to 0.10%; the balance of Fe and other unavoidable impurities;

hot rolling the aluminum killed steel slab under a finishing hot rolling temperature of 850° C. to 950° C. and a coiling temperature of 400° C. to 700° C., to form a hot rolled steel sheet;

cold rolling the hot rolled steel sheet under a cold rolling reduction ratio of 30% to 80% and annealing the cold rolled steel sheet at a temperature of 700° C. to 870° C., and then cooling the annealed steel sheet to a temperature range of 620° C. to 700° C. at a cooling rate of 1 to 7° C./sec, the steel sheet having a microstructure consisting of ferrite and austenite.

2. The method according to claim 1, wherein one or more elements selected from the group consisting of Nb: 0.001% to 0.10%, Mo: 0.05% to 0.5%, and Co: 0.01% to 1.0% are added into the aluminum killed steel slab.

* * * * *